United States Patent [19]

Will

[11] 4,405,022

[45] Sep. 20, 1983

[54] TUBULAR HANDLING SYSTEM FOR OIL DRILLING RIGS

[75] Inventor: Brian C. Will, Calgary, Canada

[73] Assignee: Slant Drilling Systems Ltd., Calgary, Canada

[21] Appl. No.: 310,548

[22] Filed: Oct. 13, 1981

[30] Foreign Application Priority Data

Jun. 3, 1981 [CA] Canada ..... 378932

[51] Int. Cl.[3] ..... E21B 19/20

[52] U.S. Cl. ..... 175/85; 175/52; 211/60 S; 226/163

[58] Field of Search ..... 175/85, 52, 161; 166/77.5, 77; 211/60 S; 414/431, 433, 745; 226/158, 162, 163, 167, 120

[56] References Cited

U.S. PATENT DOCUMENTS

| | | | |
|---|---|---|---|
| 2,692,059 | 10/1954 | Bolling, Jr. | 175/85 |
| 2,848,196 | 8/1958 | Simmonds | 175/52 |
| 3,058,533 | 10/1962 | Collins, Jr. | 175/85 |
| 3,331,585 | 7/1967 | Dubberke | 175/85 |
| 3,446,284 | 5/1969 | Dyer et al. | 175/85 |
| 3,961,673 | 6/1976 | Wolters et al. | 175/85 X |
| 3,986,569 | 10/1976 | Hilding et al. | 175/85 X |
| 4,128,135 | 12/1978 | Mitchhart et al. | 175/85 X |
| 4,171,633 | 10/1979 | Sebardt | 226/158 X |
| 4,296,820 | 10/1981 | Loftis | 175/85 X |

*Primary Examiner*—Stephen J. Novosad
*Assistant Examiner*—Thuy M. Bui
*Attorney, Agent, or Firm*—Robert F. Delbridge; Arne I. Fors

[57] ABSTRACT

Drilling apparatus includes an inclined mast, a drive carriage slidably mounted on the mast for rotating a tubular drilling member, and at least two positioning units secured to the mast at spaced positions therealong for positioning tubular drilling members. Each positioning unit has a frame which can be raised a preset distance above the mast and lowered from the preset distance. Grippers adjacent opposite sides of the frame can be raised a preset distance above the frame and lowered from the preset distance. The grippers can be moved towards one another to grip a tubular drilling member therebetween and moved away from one another to release the tubular drilling member. Locators adjacent opposite sides of the frame can be raised to cause the locators to engage and position lower parts of the tubular member, with the tubular member being movable away from the mast out of contact with the locators without moving the locators. The drive carriage is movable along the mast past at least one positioning unit.

16 Claims, 8 Drawing Figures

TUBULAR HANDLING SYSTEM FOR OIL DRILLING RIGS

Figure 1:
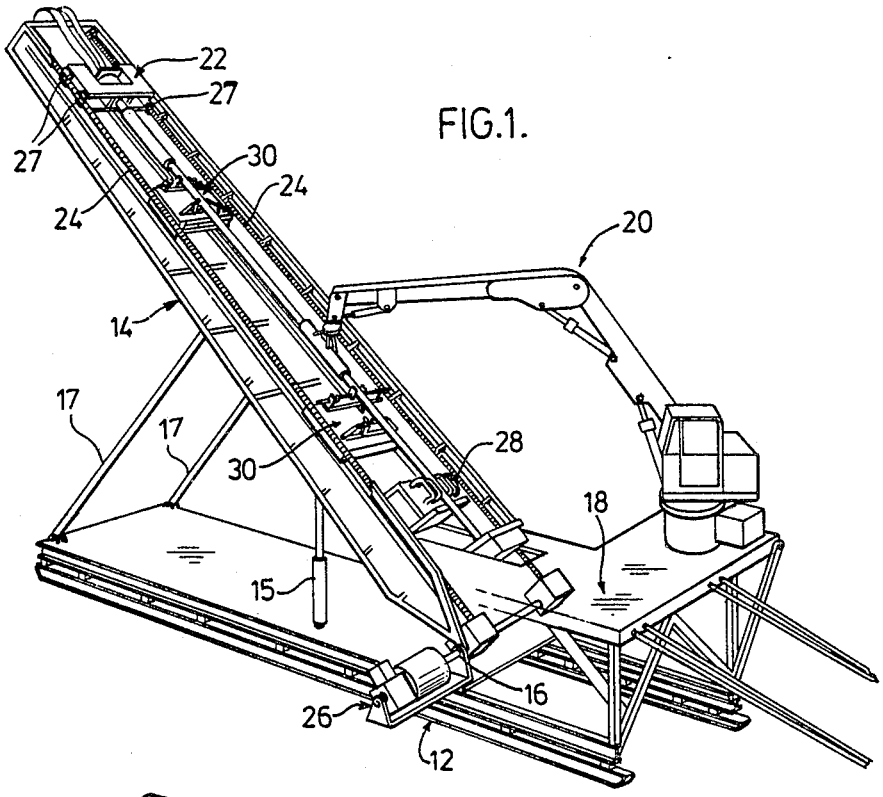

This invention relates to drilling apparatus of the kind which comprises an inclined mast carrying a slidably mounted drive carriage which rotates a string of drill rods or pipes during a drilling operation. The drive carriage moves down the mast as the string of drill pipe moves deeper into the drilled hole in the ground, and the inclination of the mast is adjustable to vary the angle at which the hole is drilled.

As is well known, it is necessary to successively add further drill pipe at the upper end of the string during a drilling operation, and such an operation requires a fresh drill pipe to be accurately aligned with the longitudinal axis of the hole being drilled before connection to the upper drill pipe of the string and to the drive carriage. A similar operation is required with the installation of the drill collars and well bore casing. All such members will hereinafter be referred to as tubular drilling members.

It is therefore an object of the invention to provide improved means for positioning a tubular drilling member prior to its connection to other drilling components.

According to the invention, a positioning unit securable to an inclined mast of drilling apparatus for positioning tubular drilling members comprises a frame, means for raising the frame a preset distance above the mast and lowering the frame from the preset distance gripping means adjacent opposite sides of the frame, means for raising the gripper means a preset distance above the frame and lowering the gripper means from the preset distance, means for moving the gripper means towards one another to grip a tubular drilling member therebetween and for moving the gripper means away from one another to release the tubular drilling member, locating means adjacent opposite sides of the frame, and means for raising the locating means to cause said locating means to engage and position lower parts of the tubular member when the tubular member is held by the gripper means, with the tubular member being movable away from the mast out of contact with the locating means without moving the locating means.

At least two positioning units are secured to the mast at spaced positions therealong, and the drive means of the drilling apparatus is movable along the mast past at least one positioning unit.

Thus, in use, it is merely necessary to raise the frame and the gripper means by the respective preset distances, move the gripper means to grip a tubular drilling member therebetween, and raise the locating means into engagement with lower parts of the tubular member. The gripper means may then be released from the tubular drilling member and lowered. Further tubular members of the same size can thereafter be accurately positioned by engagement with the locating means. When the drive means has to pass a positioning unit, the frame of the positioning unit can be lowered for this purpose, and thereafter raised again the preset distance to correctly position the locating means once again.

The frame raising and lowering means may comprise screw jacks securable to the mast and connected to the frame.

Each gripper means may comprise a roller of substantially hourglass shape freely rotatable about an axis substantially perpendicular to the plane of the mast. The gripper raising and lowering means may comprise screw jacks secured to the frame and connected to the gripper means.

The means for moving the gripper means towards and away from one another may comprise screw jacks connected between the gripper means and the gripper raising and lowering means.

Each locating means may comprise a roller of substantially cylindrical shape freely rotatable about an axis parallel to the longitudinal axis of the tubular member. The means for raising the locating means may move the locating means in upwardly and inwardly inclined directions. The means for raising the locating means may comprise screw jacks connected between the locating means and the frame.

Figure 2:
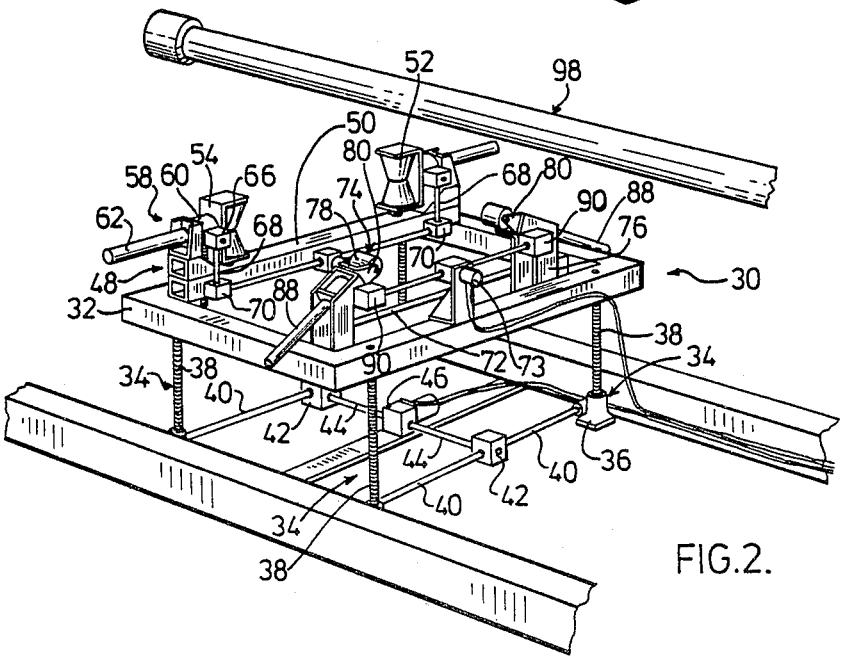
Figure 3:
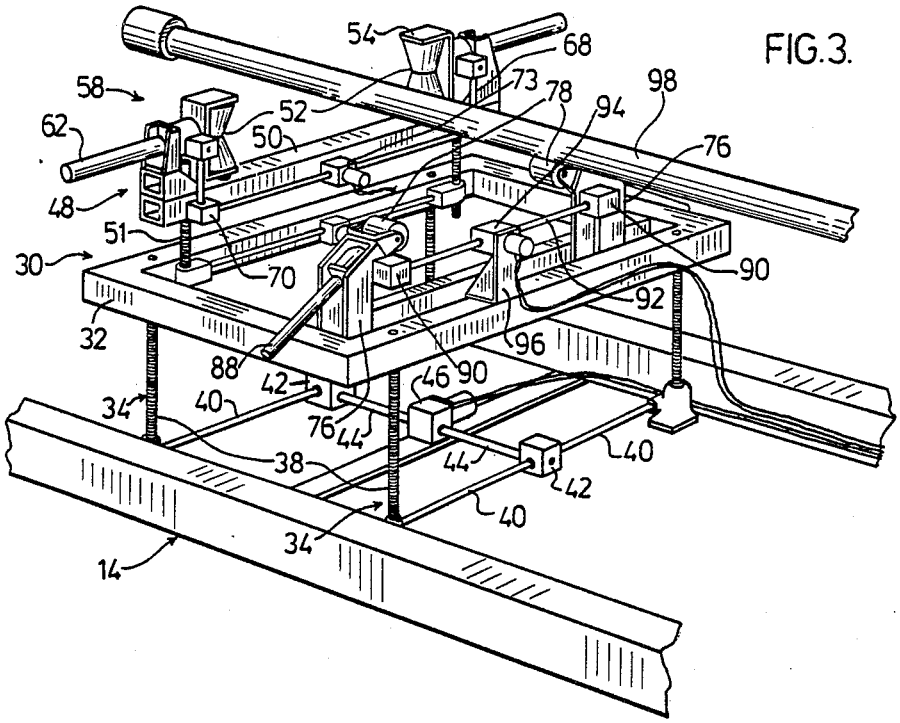
Figure 4:
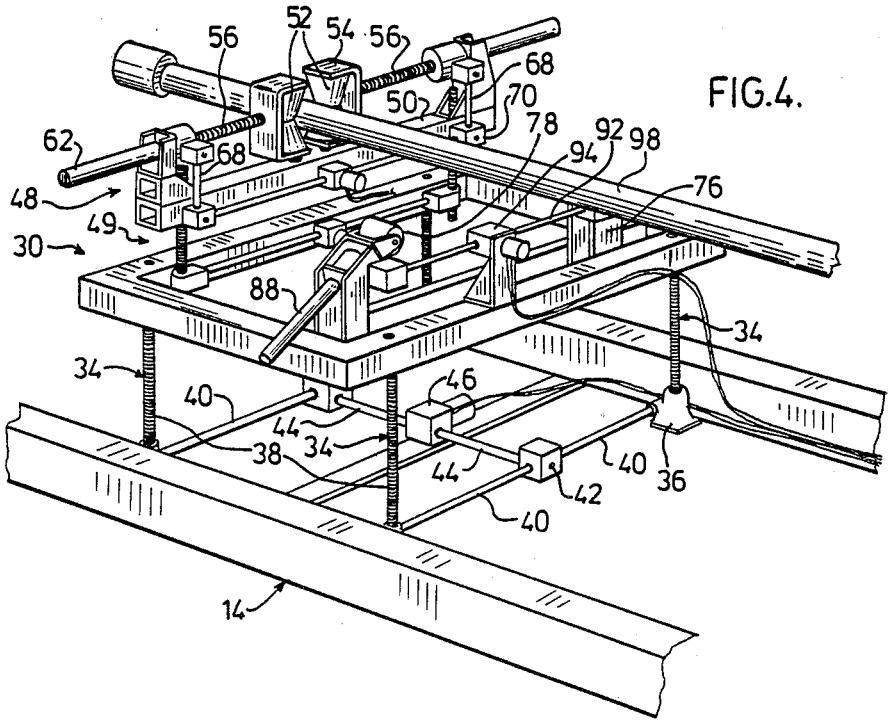
Figure 5:
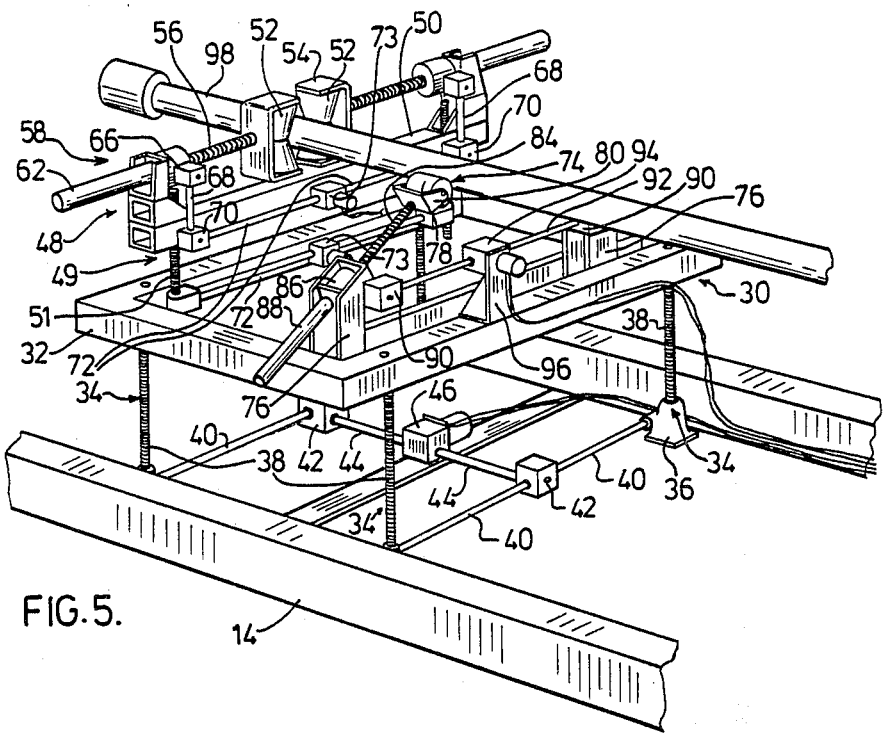
Figure 6:
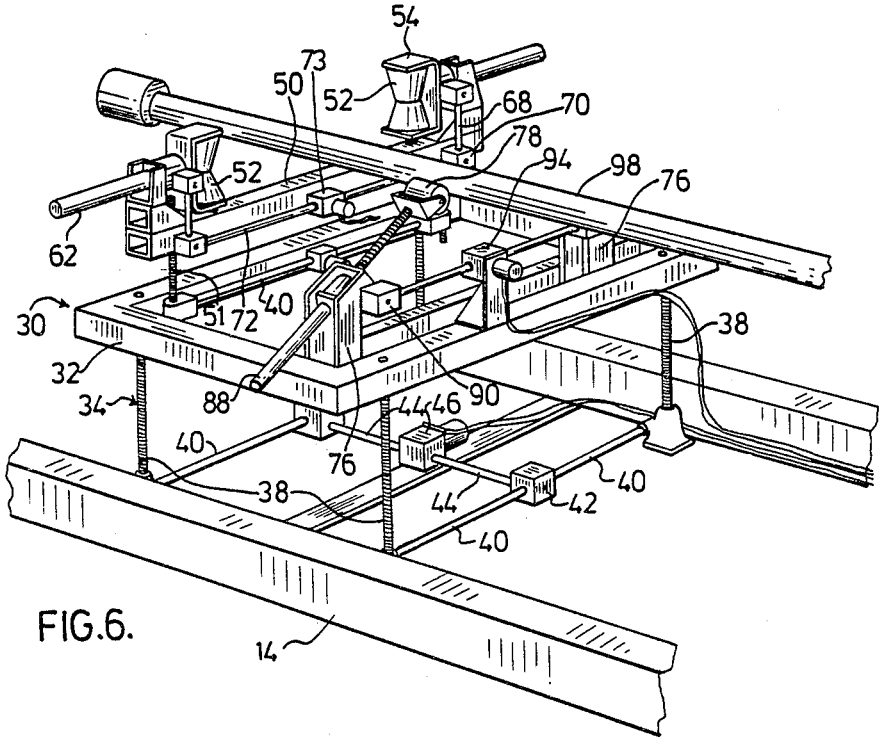
Figure 7:
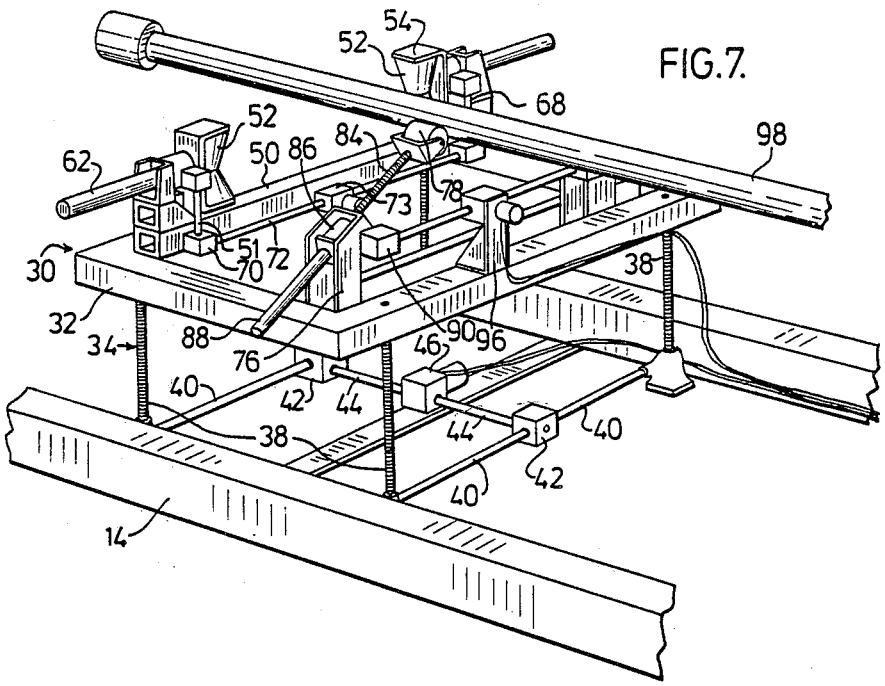
Figure 8:
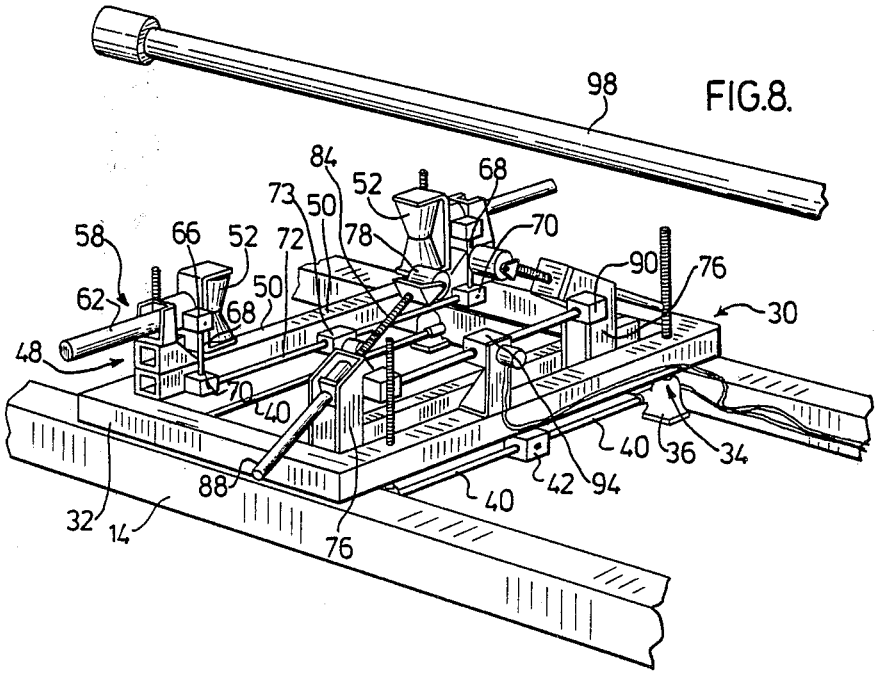

One embodiment of the invention will now be described, by way of example, with reference to the accompanying drawings, of which:

FIG. 1 is a perspective view of a drilling rig with a pair of positioning units in accordance with the invention mounted on the mast, FIG. 2 is a perspective view of the one of the positioning units with its main frame raised to the preset distance, FIG. 3 is a similar view showing the gripper means raised to the preset distance, FIG. 4 is a similar view showing the gripper means moved into gripping engagement with a tubular member, FIG. 5 is a similar view showing the locating means raised into positioning engagement with the tubular member, FIG. 6 is a similar view showing the gripper means moved out of gripping engagement with the tubular member, FIG. 7 is a similar view showing the gripper means lowered, and FIG. 8 is a similar view showing the main frame lowered but with the locating means remaining in the same position relative to the frame.

Referring first to FIG. 1, a drilling rig has a base 12 with a mast 14 having its lower end pivotally secured thereto for movement about a horizontal axis 16. The inclination of the mast 14 is adjustable by a hydraulic cylinder 15, with struts 17 being adjusted accordingly. An operator's platform 18 is also mounted on the base 12, and a small crane 20 commonly known as a cherry picker is mounted on the platform 18. A drive carriage 22 is mounted on two laterally spaced threaded rods 24 rotatably mounted at their upper ends to the top of the mast 14 and secured at their lower ends to an electric motor 26 carried by the mast 14. Each rod 24 passes through two nuts 27 at upper and lower corners on a respective side of the carriage 22, such that rotation of the rods 24 by the motor 26 moves the carriage 22 along the mast 14. A make-and-break machine 28 is secured to the lower portion of the mast 14 just above the platform 18. As so far described, the drilling rig is of conventional construction.

In accordance with the invention, a pair of positioning units 30 are secured to the mast 14 at spaced positions therealong, there being an upper positioning unit 30 just below the carriage 22 and a lower positioning unit 30 just above the make-and-break machine 28. The positioning units 30 will now be described with particular reference to FIGS. 2 to 8.

Each positioning unit 30 has a rectangular main frame 32 mounted on four lifting jacks 34 secured to the mast 14. The jacks 34 are screw jacks, with each jack 34 having a housing 36 with a screw threaded post 38 extending upwardly into a threaded aperture (not shown) in the frame 32. Each jack 34 has a horizontal projecting drive shaft 40 which is secured to a gear (not shown) meshing with the lower end of the post 38 in the housing 36 in known manner. The drive shafts 40 from the four jacks 34 extend into respective one of two gear boxes 42 which in turn are connected by drive shaft 44 to an electrically-powered motor 46. Operation of the motor 46 in one direction or the other causes rotation of the post 38 with consequent raising or lowering of the frame 32 of the positioning unit 30.

A gripper assembly 48 includes a transverse beam 50 extending across the top of the frame 32 and mounted on a pair of transversely spaced screw jacks 49 secured to the frame 32. The jacks 49 have posts 51 extending upwardly through threaded apertures (not shown) in the beam 50. The jacks 49 are operated by an electric motor (not shown) such that the gripper assembly 48 is raised or lowered relative to the frame 32 by rotation of the posts in one direction or the other. The gripper assembly 48 also includes a pair of transversely-spaced gripper rollers 52 of hourglass shape rotatably mounted in holders 54 so that the gripper rollers 52 are free to rotate about axes perpendicular to the plane of the mast 14. A threaded shaft 56 (see FIGS. 4 and 5) forming part of the screw jack 58 extends horizontally from each holder 54 into a jack housing 60. The shaft 56 projects from the housing 60 on the opposite side thereof to the holder 54 into a sleeve 62. Each jack 58 has a drive shaft (not shown) projecting from the housing 60, the drive shaft being secured to a gear (not shown) meshing with the shaft 56 in the housing 60 in known manner. Each drive shaft extends into a gear box 66 from which a drive shaft 68 extends into a gear box 70 and from which a drive shaft 72 extends into an electrically powered motor 73. Operation of the motor 73 in one direction or the other causes the gripper rollers 52 to be moved towards or away from one another.

A locating assembly 74 includes a pair of transversely-spaced pillars 76 mounted on the frame 32. A pair of transversely-spaced barrel-shaped locating rollers 78 are rotatably mounted in holders 80 so that the locating rollers 78 are free to rotate about axes parallel to the length of the mast 14. A threaded shaft 82 (see FIGS. 5 to 8) which forms part of the screw jack 84 extends rearwardly and downwardly from each holder 80 into a jack housing 86. The shaft 82 projects from the housing 86 on the opposite side thereof to the holder 80 into a sleeve 88. Each jack 84 has a drive shaft (not shown) projecting from the housing into a gear box 90, the drive shaft being secured to a gear (not shown) meshing with the shaft 82 in the housing 86 in known manner. From the gear box 90 a drive shaft 92 extends into an electrically powered motor 94 carried by a pillar 96 mounted on the frame 32. Operation of the motor 94 in one direction or the other causes the locating rollers 78 to move towards or away from one another along inclined paths.

In use, when a new size of tubular member such as a drill pipe 98 has to be added to the string, the drill pipe 98 is presented to the mast by the cherry picker 20 in approximate alignment with the centre line of the well bore centre. The main frame 32 is raised a preset distance relative to the mast 14 by operation of the lifting jacks 34 by the motor 46 as shown in FIG. 3. The gripper roller assembly 48 is then raised a preset distance relative to the frame 32 by further operation of the relevant jacks 34 such that a centre line extending between the gripper rollers 52 intersects the centre line of the hole being drilled, as shown in FIG. 3. The gripper rollers 52 are then moved towards each other by operation of the jacks 58 by the motor 74 until the gripper rollers 52 grippingly engage opposite sides of the drill pipe 98, thereby holding the drill pipe 98 in place, as shown in FIG. 4.

The jacks 84 are then operated by a motor 94 to move the locating rollers 78 upwardly and inwardly along their inclined paths into locating engagement with the opposite sides of the underneath of the dripp pipe 98, as shown in FIG. 5. The gripper rollers 52 are then retracted clear of the drill pipe 98 by operation of the jacks 58 by the motor 74, as shown in FIG. 6, with the drill pipe 98 therefore remaining resting on the locating rollers 78 of the two positioning units 30. The gripper roller assembly 48 is then lowered back onto the frame 32 by operation of the jacks 34, as shown in FIG. 7.

At this stage, the cherry picker 20 is still holding the drill pipe 98 which is resting on the locating rollers 78 of both positioning units 30. The carriage 22 is then moved down the mast from an upward position so that its male thread member engages in the female thread of the drill pipe 98, with the male thread member then being rotated to tighten the connection. The cherry picker 20 is then released from the drill pipe 98 and the carriage 22 with attached drill pipe 98 is moved downwardly further along the mast to engage the male end of the drill pipe 98 into the upper female end of the uppermost drill pipe in the drilled hole, with the drill pipe 98 then being rotated to effect the connection. The make-and-break machine 28 is then operated to secure the connection. The main frame 32 of each positioning unit 30 is then lowered back onto the mast 14 by operation of the jacks 34 by the motor 46, as shown in FIG. 8.

The carriage 22 is then caused to rotate the complete string of drill pipes and drill further into the hole, with the carriage 22 travelling down the mast over the retracted positioning units 30.

When another drill pipe has to be inserted, the carriage 22 is disconnected from the upper drill pipe and returned to the position shown in FIG. 1. It is then merely necessary to raise the frame 32 of each positioning unit 30 to the position shown in FIG. 7 and the locating rollers 78 will be in the correct position for accurately locating a further drill pipe 98. The further drill pipe 98 can therefore be readily positioned on the locating rollers 78 by the cherry picker 20 and the necessary connections made as before.

The drill pipe 98 can be withdrawn by loosening the threaded connection between the carriage 22 and the uppermost drill pipe 98 by operation of the make-and-break machine 28, moving the carriage 22 and attached drill rods 98 up the mast 14, raising the frames 32 of the positioning units 30 to position the locating rollers 74 in engagement with the uppermost drill pipe 98, gripping the uppermost drill pipe 98 with the cherry picker 20, breaking the connection between the lower end of the uppermost drill pipe 98 and the upper end of the next drill pipe, detaching the carriage 22 from the uppermost drill pipe and removing the drill pipe 98 by means of the cherry picker 20. Subsequent drill pipes can be removed by repeating this procedure.

The advantage of the invention are readily apparent from the above description. Once each positioning unit 30 has been set for a drill pipe of a given diameter, further drill pipes of the same diameter can be added to the string without adjustments by operators being required.

Although the preferred embodiment has been described with reference to drill pipes, it will be clear that the invention is also applicable to other tubular members used in drilling, such as drill collars and well bore casing.

Other embodiments of the invention will be clearly apparent to a person skilled in the art, the scope of the invention being defined in the appended claims.

What I claim as new and desire to protect by Letters Patent of the United States is:

1. Drilling apparatus comprising an inclined mast, drive means slidably mounted on the mast for rotating a tubular drilling member, and at least two positioning units secured to the mast at spaced positions therealong for positioning tubular drilling members, each positioning unit comprising a frame, means for raising the frame a preset distance above the mast and lowering the frame from the preset distance, gripper means adjacent opposite sides of the frame, means for raising the gripper means a preset distance above the frame and lowering the gripper means from the preset distance, means for moving the gripper means towards one another to grip a tubular drilling member therebetween and for moving the gripper means away from one another to release the tubular drilling member, locating means adjacent opposite sides of the frame, and means for raising the locating means to cause said locating means to engage and position lower parts of the tubular member, with the tubular member being movable away from the mast out of contact with the locating means without moving the locating means, said drive means being movable along the mast past at least one positioning unit.

2. Drilling apparatus according to claim 1 wherein the frame raising and lowering means comprises screw jacks secured to the mast and connected to the frame.

3. Drilling apparatus according to claim 1 wherein each gripper means comprises a roller of substantially hourglass shape freely rotatable about an axis substantially perpendicular to the plane of the mast.

4. Drilling apparatus according to claim 1 wherein the gripper raising and lowering means comprises screw jacks secured to the frame and connected to the gripper means.

5. Drilling apparatus according to claim 1 wherein the means for moving the gripper means towards and away from one another comprises screw jacks connected between the gripper means and the gripper raising and lowering means.

6. Drilling apparatus according to claim 1 wherein each locating means comprises a roller of substantially cylindrical shape freely rotatable about an axis parallel to the longitudinal axis of the tubular member.

7. Drilling apparatus according to claim 1 wherein the means for raising the locating means moves the locating means in upwardly and inwardly inclined directions.

8. Drilling apparatus according to claim 1 wherein the means for raising the locating means comprises screw jacks connected between the locating means and the frame.

9. A positioning unit securable to an inclined mast of drilling apparatus for positioning tubular drilling members, said positioning unit comprising a frame, means for raising the frame a preset distance above the mast and lowering the frame from the preset distance when the positioning unit is secured to the mast, gripper means adjacent opposite sides of the frame, means for raising the gripper means a preset distance above the frame and lowering the gripper means from the preset distance, means for moving the gripper means towards one another to grip a tubular drilling member therebetween and for moving the gripper means away from one another to release the tubular drilling member, locating means adjacent opposite sides of the frame, and means for raising the locating means to cause said locating means to engage and position lower parts of the tubular member, with the tubular member being movable away from the mast, when the positioning unit is secured thereto, out of contact with the locating means without moving the locating means.

10. A positioning unit according to claim 9 wherein the frame raising and lowering means comprises screw jacks securable to the mast and connected to the frame.

11. A positioning unit according to claim 9 wherein each gripper means comprises a roller of substantially hourglass shape freely rotatable about an axis substantially perpendicular to the plane of the mast when the positioning unit is secured thereto.

12. A positioning unit according to claim 9 wherein the gripper raising and lowering means comprises screw jacks secured to the frame and connected to the gripper means.

13. A positioning unit according to claim 9 wherein the means for moving the gripper means towards and away from one another comprises screw jacks connected between the gripper means and the gripper raising and lowering means.

14. A positioning unit according to claim 9 wherein each locating means comprises a roller of substantially cylindrical shape freely rotatable about an axis parallel to the longitudinal axis of the tubular member.

15. A positioning unit according to claim 9 wherein the means for raising the locating means moves the locating means in upwardly and inwardly inclined directions.

16. A positioning unit according to claim 9 wherein the means for raising the locating means comprises screw jacks connected between the locating means and the frame.

* * * * *